United States Patent [19]

Eagar et al.

[11] Patent Number: 4,869,757

[45] Date of Patent: Sep. 26, 1989

[54] SILVER ALLOYS OF EXCEPTIONAL AND REVERSIBLE HARDNESS

[75] Inventors: Thomas W. Eagar, Belmont; Dwarika P. Agarwal, Attleboro, both of Mass.; Laura L. Bourguignon, East Providence, R.I.; Rosaire Marcotte, Attleboro, Mass.

[73] Assignee: Leach & Garner Company, Attleboro, Mass.

[21] Appl. No.: 37,533

[22] Filed: Apr. 13, 1987

[51] Int. Cl.[4] ..... C22F 1/14; C22C 5/08

[52] U.S. Cl. ..... 148/158; 148/405; 420/502

[58] Field of Search ..... 420/502; 148/405, 430, 148/158

[56] References Cited

U.S. PATENT DOCUMENTS

| | | | |
|---|---|---|---|
| 1,970,319 | 8/1934 | Kern | 420/502 |
| 1,984,225 | 12/1934 | McFarland | 148/405 |
| 2,196,302 | 4/1940 | Hensel et al. | 420/502 |
| 2,196,303 | 4/1940 | Hensel et al. | 420/502 |
| 2,235,634 | 3/1941 | Hensel et al. | 420/502 |

OTHER PUBLICATIONS

Gubin et al., "Brazing Corrosion-Resistant Steels", Svar. Proiz., 1971, No. 11, pp. 39–41.

*Primary Examiner*—L. Dewayne Rutledge
*Assistant Examiner*—Robert L. McDowell
*Attorney, Agent, or Firm*—George W. Dishong

[57] ABSTRACT

A unique hardenable silver alloy is provided which is solution annealed and preferably age-hardened to yield a silver alloy of exceptional and reversible hardness. The alloys utilize intermetallic systems comprising; silver, copper, combined with lithium alone or tin alone in varying percent amounts, or silver, copper, lithium and either tin or antimony, or silver, copper, lithium, tin and antimony, or silver, copper, lithium, tin and bismuth, or silver, copper, lithium, tin, bismuth and antimony.

13 Claims, 1 Drawing Sheet

SILVER ALLOYS OF EXCEPTIONAL AND REVERSIBLE HARDNESS

BACKGROUND OF THE INVENTION

1. Field of the Invention

The present invention is concerned generally with silver compositions of increased hardness and is particularly directed to silver alloys containing intermetallic compounds which can be subsequently heat treated to provide exceptional and reversible hardness.

2. Description of the Prior Art

It has been recognized for many centuries that pure silver is extremely soft and must be strengthened for even the least demanding applications. For this reason, many methods of hardening silver have been introduced: the primary methods being alloying and mechanical working. Mechanical working will increase the disorder in the silver metal crystal producing a phenomenon known as work hardening. This process is reversible in that elevated temperatures return the strength of the metal to that of the unworked solid solution or the pure metal. Unfortunately, undesireable hardening often takes place during the forming of silver articles. The metal becomes harder as it is formed, not softer, and subsequent application of heat to the fully formed article part will soften it. Although, many metalsmiths continue to take advantage of the added strength obtained by mechanical working of the metal, this method of hardening cannot always be employed and does not always permit the optimum hardness during processing.

In comparison, the method of alloying achieves added strength through solid solution hardening. It is commonly recognized that a mixture of two different metals is always stronger than one of the two pure metals itself. The traditional alloy of pure silver is sterling silver consisting of 92.5% by weight of pure silver and 7.5% by weight of copper. This form of hardening is not reversible in that the alloy once formed cannot be returned to the strength of the individual metals that formed it. It is generally necessary to work alloys at their full strength.

While other methods of strengthening precious metals are known including control of the grain size and crystal dispersion strengthening, the magnitude of the strengthening is found to be very small at best. Other methods of hardening such as ordered solution hardening or phase transformation hardening, while effective, are not known for use in silver or silver alloys. As a result, the only practical approach has become the preparation of different silver containing alloys which are then mechanically work hardened or age hardened at elevated temperatures to provide sterling silver alloys of increased hardness.

Representative of this general approach and of the developments in recent years are the following patents: U.S. Pat. No. 1,022,600 describing a silver alloy composed principally of silver, copper, and traces of titanium; U.S. Pat. No. 1,928,429 describing an annealed alloy consisting of silver from about 50–90%, beryllium from about 0.10–2.5%, and copper; U.S. Pat. No. 1,970,319 describing a tarnish-resisting silver alloy made from about 85–93% silver, tin, and up to 4% of either cadmium, antimony, copper, zinc, manganese and nickel-chromium; U.S. Pat. No. 1,984,225 describing an age hardening process for hardening silver and a silver alloy containing at least 92.5% silver, aluminum, and copper; U.S. Pat. No. 2,196,302 describing a silver alloy containing silver, copper, and lithium; U.S. Pat. No. 2,196,303 which describes another alloy containing silver, lithium, and copper in varying proportions; U.S. Pat. No. 2,235,634 which describes a silver solder whose essential ingredients are silver, copper, and lithium; and British Pat. No. 573,661 which describes a silver solder alloy consisting of silver, copper, tin, and zinc.

Despite these innovations and the introduction of the age hardening process to increase the hardness of silver and silver alloys, the presently available sterling silver alloys are relatively soft. For this reason, a sterling silver alloy which could be subsequently hardened and which would then demonstrate significant increases of hardness as well as reversible hardness would represent a major advance and improvement in this art. Insofar as is presently known, sterling silver alloys demonstrating exceptional and reversible hardness, though highly useful and desireable, have not been available.

SUMMARY OF THE INVENTION

The present invention provides a hardenable silver alloy comprising not less than 90% silver; not less than 2.0% copper; and at least one metal selected from the group consisting of lithium, tin and antimony. The silver alloy also provides for the addition of bismuth in the composition in a quantity up to 0.5% by weight.

Preferably, the metals comprising the alloy are combined and heated to a temperature not substantially less than 1250° F. to anneal the alloy into a solid solution. The annealed alloy is then quickly cooled by quenching to ambient temperature. The annealed alloy is then preferably age hardened by subjecting the alloy to a temperature ranging between 300°–700° F. for a predetermined time period followed by cooling of the age hardened alloy to ambient temperature. The age hardened silver alloy demonstrates a hardness substantially greater than that of traditional sterling silver typically 100 HVN (Vickers Hardness Number) and is capable of being reversed by elevated temperatures into a relatively soft alloy state.

BRIEF DESCRIPTION OF THE DRAWINGS

The present invention may be more easily and completely understood when taken in conjunction with the accompanying drawing, in which: The FIGURE graph illustrating the solid solution annealing process and the age hardening process useful with the present invention.

DESCRIPTION OF THE PREFERRED EMBODIMENTS

Figure 1:
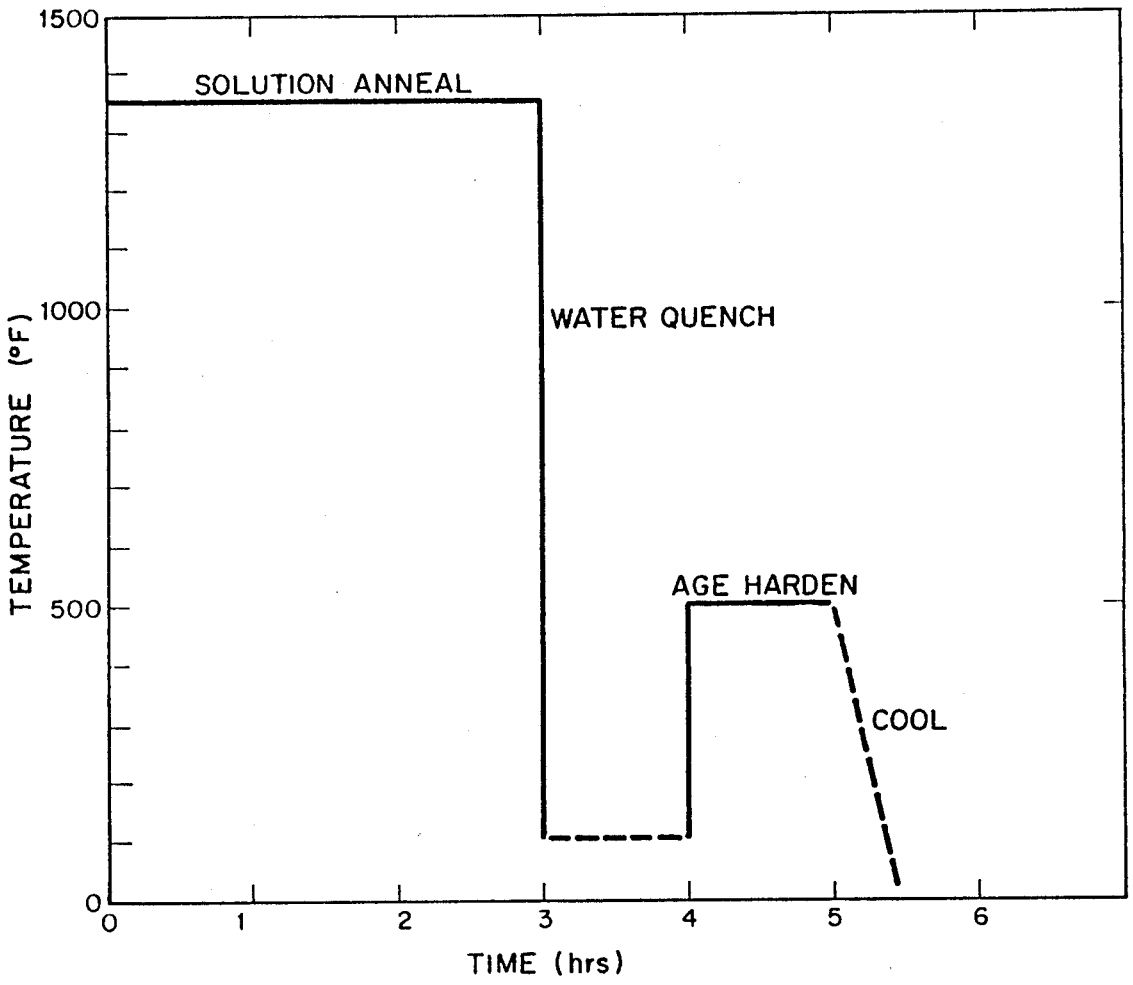

The present invention is a hardenable, silver alloy comprising either three, four, five or six different metals which after annealing and heat treatment demonstrate a substantially increased hardness which is reversible upon additional application of heat. The novel alloys thus are ternary, quaternary, quinary or senary systems comprising at least 90.0 weight percent silver and not less than 2.0 weight percent copper. The choice of other metals include lithium or tin alone or in combination with antimony; and each of these alone or in combination with a sixth metal, bismuth. In certain instances therefore the use of tin, antimony, bismuth, and lithium in combination with silver and copper will form a senary alloy of metals as a preferred embodiment of the present invention.

The preferred embodiment of the present invention exhibits or demonstrates particularly useful advantages with the use of intermetallic compounds to produce a silver alloy which is then able to be heat treated in a predetermined manner to yield an alloy of exceptional hardness relative to presently known silver alloys. While the use of lithium in sterling silver alloys is known in this art, the use of such lithium, in small amounts, has been solely as a deoxidizer and as a consequence of the oxygen being removed, will soften rather than harden the silver alloy. In contrast to these earlier alloy blends, the present invention provides ternary, quaternary, quinary and even senary metallic systems utilizing not less than 90.0 weight percent silver as one of the requisite metals.

The intermetallic silver alloys provide exceptional hardness in comparison to the hardness of previously available sterling silver blends. The present invention also provides several other major advantages and features which were not available for sterling silver alloys previously. Alloys made in accordance with the present invention, be they ternary, quaternary, quinary, or senary systems in composition, yield a silver alloy with reversible hardness. Each alloy can be resoftened by subsequent heating and quenching to yield the alloy in its original blended state; this softened alloy can then be hardened again by a subsequent precipitation heat treatment. This process relies on the precipitation of a minor metal phase to precipitate out of the major silver phase upon heating to cause lattice distortion and hardening of the alloy. The reversible hardness feature of the present invention is clearly different from the hardening resulting from the addition of most reactive metals such as aluminum, magnesium or titanium which cause the formation of a metallic oxide to harden the silver but which for all practical purposes is not reversible subsequently.

Another major characteristic of the silver alloys made in accordance with the present invention is their non-toxic character—that is, they can be used without fear of any ill effects caused by the metals used in making the alloy. It is commonly recognized that silver alloys employing beryllium are not desirable for use as jewelry or articles intended for contact with food because beryllium is a toxic metal. The present invention comprising any of the alloy systems is known to be non-toxic.

The silver alloys described herein demonstrate a strong springback quality and are resistant to deformation. These qualities are particularly desirable in jewelry applications in that clasps will remain more secure due, at least in part, to the strong springback quality. The silver finish will demonstrate a greater resistance to scratches and dents—thus making the jewelry item more attractive and valuable to its owner. In addition, when the novel silver alloys are utilized in the making of articles in hollow and/or flat silverware, their demonstrated and improved hardness permits the manufacturer to utilize thinner walls of the alloy in their construction and thus make the article available at a lower cost to the consumer. It is also expected that many advantages in both the springback quality and deformation resistance will be useful in the electronics industry, for example in the making of contact relays.

The hardenable silver alloys comprising the present invention are composed of not less than three metals, and in many preferred embodiments will comprise four five and six metals as an alloy. Regardless of whether the alloy is a ternary, quaternary, quinary or senary metallic system, three metals will always be utilized. These are: silver in an amount not less than 90.0 weight percent; copper in an amount not less than 2.0 weight percent; and lithium or tin in an amount not less than 0.02 or 0.28 weight percent respectively. In the quaternary metallic systems comprising silver, copper, and lithium in the same weight percent as in the ternary systems the fourth metal is either tin or antimony tin in the range of 0.28 to 4.0 weight percent and antimony in the range of 0.10 to 0.80 weight percent. In those embodiments comprising quinary metallic systems, the metals include, in addition the quaternary mettalic systems of silver, copper, lithium and tin; alternately the quaternary system of silver, copper lithium and antimony, any one of two selected from the group consisting of tin (where antimony was part of the quaternary system) in quantities having the same ranges as stated above for the quaternary system and bismuth in quantities ranging from 0.1–0.5 weight percent. In those embodiments which are senary metallic systems, all six metals—silver, copper, lithium, tin, antimony, and bismuth—are utilized in quantities (weight percent) as previously stated.

The making of the silver alloy follows procedures conventionally known in the art. Initially it is preferred that a master alloy containing silver and some lithium be prepared and then melted with copper and the intermetallic compound forming elements comprising one or more of the metals tin, antimony, or bismuth in combination with lithium. The final alloys are then formed in the conventional manner to obtain the final product.

The alloy is then annealed for a predetermined period of time at an elevated temperature. The temperature for solid solution annealing will vary with the composition of the intermetallic compound added to the silver and copper in the alloy. The suitable annealing temperature is one which will substantially soften the alloy.

A range of temperatures between 1250°–1400° F. is deemed to be useful for annealing purposes. Optimally, it has been found that an anneal of 1350° F. for 2 hours is best for successful hardening of the annealed alloy subsequently. Prealloying of lithium with silver to prevent lithium burnoff in addition to continuous casting, improved the product. Furthermore, while 2 hours of annealing time was considered optimum, this annealing time may be varied from ½ hour to 4 hours depending upon the variety and quantity of metals as well as the thickness of the product being produced.

Subsequently, at the end of the annealing duration, the solid solution of metals is cooled rapidly or quenched thereby bringing the alloy to ambient room temperature. After quenching, the alloy is preferably age hardened to obtain the precipitation hardening effect. Age hardening comprises elevating the alloy to a temperature ranging from 300°–700° F., and maintaining the alloy at this temperature uniformly for a period ranging typically from ½ to 24 hours. Testing has demonstrated that the optimum aging time and temperature is from about 400° F. to about 500° F. for one hour to produce the highest hardness in the alloy for most embodiments of the present invention. The age-hardened alloy is then allowed to cool to ambient room temperature. The entirety of these processing steps are summarized by FIG. 1.

It will be clearly understood that the present invention comprises the making of silver alloys comprising three, four, five, or six different metals subsequent to annealing of the alloy and age-hardening the alloy. It would be also understood that the alloys of this invention may be work hardened rather than age-hardened. Accordingly, the invention is a hardenable silver alloy whose characteristic properties of exceptional and reversible hardness are demonstrable and measurable only after the solution annealing and age-hardening prosesses have been completed. The distinction between the different metallic systems used in the silver alloy and the subsequent demonstration of its properties and characteristics after processing must be understood and distinguished at all times to properly understood the essence and definition of the present invention. With this understanding in mind, the following examples are presented to demonstrate the different metals which may be utilized alone or in combination in the present invention; to provide the range of concentration for each of the metals deemed useful for the hardening compounds; to demonstrate the exceptional hardness of representative alloys comprising the present invention; and to demonstrate the effect of varying the age-hardening process upon the hardness of different embodiments comprising the present invention. In addition, it will be clearly and explicitly understood, that while specific quantities of individual metals as weight percents are identified for specific embodiments, each of these are merely illustrative of the present invention as a whole; none of these parameters are deemed to limit or restrict the scope of the present invention in any manner.

EXAMPLE 1

To demonstrate the quaternary intermetallic system, a preferred alloy comprising silver, copper, lithium and tin was utilized with varying proportions of lithium and tin respectively. Eighteen different alloys containing different portions of lithium and tin were prepared which varied in their weight ratio of lithium to tin; and in the total weight percent of lithium and tin in the alloy. For comparative purposes, a nineteenth alloy composed only of copper and silver, the traditional sterling silver alloy, was prepared. Each alloy was annealed at 1350° F. for two hours; quenched in water; and age-hardened at temperatures varying from 300°–700° F. for one hour. The results are presented in Tables 1 and 2 below. It should be clearly noted although known to one of ordinary skill in the art that when the silver is in proportions other than 92.5 weight percent the copper amount is altered accordingly. The amount of silver may range from about 90 to about 97.95 weight percent.

TABLE 1

| Alloy | Weight % Ag | % Cu | % Li | % Sn | Atomic Ratio Li:Sn | Total Wt. Percent Li + Sn | Highest Hardness After Heat Treatment |
|---|---|---|---|---|---|---|---|
| 1 | 92.5 | 5.7 | 0.1 | 1.7 | 1:1 | 1.8 | 160 |
| 2 | 92.5 | 3.9 | 0.2 | 3.4 | 1:1 | 3.6 | 129 |
| 3 | 92.5 | 6.6 | 0.05 | 0.85 | 1:1 | 0.90 | 203 |
| 4 | 92.5 | 5.72 | 0.18 | 1.6 | 2:1 | 1.78 | 168 |
| 5 | 92.5 | 5.74 | 0.36 | 1.4 | 4.4:1 | 1.76 | 163 |
| 6 | 92.5 | 6.11 | 0.02 | 1.37 | 1.4 | 1.39 | 174 |
| 7 | 92.5 | 7.08 | 0.08 | 0.32 | 4.3:1 | 0.40 | 182 |
| 8 | 92.5 | 5.81 | 0.32 | 1.37 | 4:1 | 1.69 | 174 |
| 9 | 92.5 | 1.96 | 0.08 | 5.46 | 1:4 | 5.54 | 49 |
| 10 | 92.5 | 6.96 | 0.03 | 0.51 | 1:1 | 0.54 | 90 |
| 11 | 92.5 | 7.32 | 0.01 | 0.17 | 1:1 | 0.18 | 75 |
| 12 | 92.5 | 6.65 | 0 | 0.85 | | | 190 |
| 13 | 92.5 | 7.45 | 0.05 | 0 | | | 152 |
| 14 | 92.5 | 4.34 | 0.09 | 3.07 | | | 148 |
| 15 | 92.5 | 5.8 | 0 | 1.7 | | | 170 |
| 16 | 92.5 | 4.1 | 0 | 3.4 | | | 127 |
| 17 | 92.5 | 7.4 | 0.1 | 0 | | | 122 |
| 18 | 92.5 | 7.3 | 0.2 | 0 | | | 158 |
| 19 | 92.5 | 7.5 | 0.00 | 0.00 | 0:0 | 0.00 | 102 |

TABLE 2

| Sample Treatment | Hardness (HVN) After Heat Treatments — Alloy No. 1 | 2 | 3 | 4 | 5 | 6 | 7 | 8 | 9 | 10 | 11 | 19 |
|---|---|---|---|---|---|---|---|---|---|---|---|---|
| As-Rolled | 185 | 172 | 185 | 172 | 181 | 170 | 160 | 168 | 161 | 162 | 164 | 156 |
| Solution Annealed 1350° F. 2 Hours | 61 | 56 | 58 | 56 | 59 | 55 | 61 | 56 | 47 | 91 | 70 | 32 |
| Aged, 1 Hr. | | | | | | | | | | | | |
| 300° F. | — | — | 162 | 144 | 150 | — | — | — | — | — | — | — |
| 400° F. | 105 | 112 | 203 | 168 | 164 | — | — | — | — | 84 | 82 | 82 |
| 500° F. | 160 | 129 | 174 | 164 | 158 | 175 | 182 | 174 | 49 | 90 | 75 | 102 |
| 600° F. | 146 | 113 | 165 | 150 | 147 | 122 | 48 | 179 | 44 | 92 | 82 | 89 |
| 700° F. | 131 | 98 | 112 | 129 | 116 | — | — | — | — | — | — | — |

Initially it should be noted that the hardness as measured in HVN (according to ASTM Spec. E384-73), using a 200 gram load applied 12 seconds varied as a function of the temperature at which age hardening occurs. Generally, with minor exceptions, it is demonstrated that 500° F. for one hour provides the highest hardness for each alloy in the quaternary metallic system.

In addition, the data of Table 1 identifies several unusual characteristics for silver alloys employing lithium and tin in combination. First, using alloy number 19 (silver and copper alone) as the comparative basis, alloy number 3 demonstrated the greatest degree of hardness—203 HVN. Note that the total weight percent of lithium and tin in combination was only 0.90 and the atomic ratio 1:1. If the 1:1 ratio of lithium: tin is maintained, reducing the total percent of lithium and tin in combination reduces hardness to below that of traditional sterling silver alone (numbers 10 and 11), while increasing the total percentage of lithium and tin in combination to 3.6% also reduced the hardness but to an extent still greater than traditional sterling silver alone (alloy number 2). In comparison, if the weight ratio of lithium: tin is altered in the extreme (4:1 or 1:4) an increase in hardness in comparison to conventional sterling silver is observed (alloy number 7 and 8 respectively) but only if the total percent of lithium and tin in combination remains at a reduced level (alloy number 9). Accordingly, the parameters of atomic ratio and total percentage of lithium and tin are interrelated, one bearing directly on the other to affect the hardness of the alloy. Clearly, alloy number 3 represents the best mode in which there is a small (1:1 ) atomic ratio and a relatively small total weight percent of lithium and tin in combination in the alloy. If it is desirable to increase the atomic ratio of lithium: tin, then it appears that the total percentage of lithium and tin in combination in the alloy should be maintained at a minimum, preferably not greater than 2.0 weight percent. Conversely, if it is desirable to increase the total percentage of lithium and tin in combination in the alloy, the atomic ratio of lithium: tin should be restricted to the preferred 1:1 ratio in order to achieve the greatest hardness after heat treatment. On this empirically demonstratred basis, useful embodiments of the hardenable sterling silver alloy of the present invention will comprise: not less than 90.0 weight percent silver; not less than 2.0 weight percent copper; not less than 0.02 weight percent lithium; and not less than 0.28 weight percent tin.

EXAMPLE 2

To demonstrate quaternary systems utilizing intermetallic compounds of lithum and antimony and quinary systems using intermetallic compounds containing lithium, tin, antimony and bismuth in varying combination, a second series of alloys were prepared according to the formulations presented by Table 3 below.

TABLE 3

| Alloy | Weight % Ag | % Cu | % Li | % Sn | % Sb | % Bi | Intermetallic Compound Added | Highest Hardness After Heat Treatment |
|---|---|---|---|---|---|---|---|---|
| A | 92.5 | 6.9 | 0.1 | — | — | 0.5 | Li-Bi | 60 |
| B | 92.5 | 6.0 | 0.15 | 0.85 | — | 0.5 | Li-Bi-Sn | 185 |
| C | 92.5 | 7.0 | 0.1 | — | 0.4 | — | Li-Sb | 166 |
| D | 92.5 | 6.15 | 0.1 | 0.85 | 0.4 | — | Li-Sb-Sn | 173 |
| E | 92.5 | 5.4 | 0.3 | 1.7 | — | 0.1 | Li-Bi-Sn | 164 |
| F | 92.5 | 7.0 | 0.3 | 0.28 | — | 0.17 | Li-Bi-Sn | 206 |
| G | 92.5 | 4.8 | 0.2 | 1.7 | 0.8 | — | Li-Sb-Sn | 133 |
| H | 92.5 | 6.82 | 0.05 | 0.43 | 0.2 | — | Li-Sb-Sn | 187 |
| J (19) | 92.5 | 7.5 | — | — | — | — | none | 102 |

Each of the alloys A–H were individually prepared as earlier described herein, annealed at 1350° F. for 2 hours, quenched in water, and age-hardened at 500° F. for one hour. The hardness of each alloy was then evaluated and recorded in HVN units. Alloy J is identical to alloy number 19 of Tables 1 and 2 and serves as an empirical control by which to evaluate the hardness of the different alloys A–H respectively.

Initially, it is clear that the quaternary metallic system of silver and copper in combination with lithium and bismuth fails to demonstrate the hardness equal to conventional sterling silver and thus is not an embodiment of the present invention. On the other hand, the quaternary system utilizing an intermetallic compound of lithium and antimony (alloy C) clearly evidences an increased hardness in comparison to conventional sterling silver alloy, and thus is a useful embodiment of the present invention. Equally important, the quinary metallic alloys comprising lithium—antimony—tin (alloy D), or lithium—bismuth—tin (alloys B, E and F), or lithium—antimony—tin (alloys G and H) each demonstrate silver.

On this empirically demonstrated basis therefore, hardenable silver alloys of the present invention will comprise: not less than 90.0 weight percent silver; not less than 2.0 weight percent copper; not less than 0.02 weight percent lithium or not less than 0.28 weight percent tin. In addition to the aforementioned ternary alloys, additional useful alloys are provided by selecting at least one additional metal from the group consisting of lithium when not a component of the ternary alloy in an amount ranging from 0.02–0.40 weight percent, tin (when not a component of the ternary alloy) in an amount ranging from 0.28–4.0 weight percent, antimony in an amount ranging from 0.1–0.8 weight percent, and bismuth in an amount ranging from 0.1–0.5 weight percent.

In addition, it will be recognized by practitioners ordinarily skilled in this art that due to the high temperatures employed during the solid solution annealing of the alloy, the subsequently obtained age-hardened alloy demonstrates a vary large grain size. It is commonly recognized that fabrication and configuration of articles using sterling silver alloys of large grain causes problems relative to appearance or formability. For this reason, preferred embodiments of the present invention utilizing the ternary, quaternary, quinary or senary metallic system may include conventionally known grain refiners, such as nickel and/or iridium and/or ruthenium, and/or rhenium and/or zirconium as an extra component of components of the alloy.

The present invention is not to be restricted in form nor limited in scope except by the claims appended hereto:

What we claim is:

1. A hardenable silver alloy comprising:

not less than 92.5 weight percent silver;

not less than 2.0 weight percent copper; and from about 0.28 weight percent to about 4.0 weight percent tin.

2. A hardenable silver alloy comprising:
not less than 90.0 weight percent silver;
not less than 2.0 weight percent copper;
from about 0.02 weight percent to about 0.40 weight percent lithium; and
from about 0.28 weight percent to about 4.0 weight percent tin.

3. A hardenable silver alloy comprising:
not less than 90.0 weight percent silver;
not less than 2.0 weight percent copper;
from about 0.02 weight percent to about 0.40 weight percent lithium; and
from about 0.1 weight percent to about 0.8 weight percent antimony.

4. A hardenable silver alloy comprising:
not less than 90.0 weight percent silver;
not less than 2.0 weight percent copper;
from about 0.02 weight percent to about 0.40 weight percent lithium; and
from about 0.28 weight percent to about 4.0 weight percent tin; and
from about 0.1 weight percent to about 0.8 weight percent antimony.

5. A hardenable silver alloy comprising:
not less than 90.0 weight percent silver;
not less than 2.0 weight percent copper;
from about 0.02 weight percent to about 0.40 weight percent lithium;
from about 0.28 weight percent to about 4.0 weight percent tin; and
from about 0.1 weight percent to about 0.5 weight percent bismuth.

6. The hardenable silver alloy as recited in claim 1, 2, 3, 4 or 5 further comprising at least one grain refiner selected from the group consisting of nickel and iridium.

7. A hardenable silver alloy comprising:
about 92.5 weight percent silver;
about 6.6 weight percent copper;
about 0.05 weight percent lithium; and
about 0.85 weight percent tin.

8. A process of making hardened silver alloys comprising the steps of:
alloying at least 92.5 percent silver, at least 2.0 percent copper and from about 0.02 weight percent to about 0.40 weight percent lithium;
solution annealing and quenching said alloy at a temperature ranging from about 1250°-1400° F. for a period of time between about ½ hour to about 4.0 hours; and
age-hardening by heating said alloy at a temperature ranging from 300°-700° F. for a period of time between about ½ hour to about 24.0 hours.

9. A process of making hardened silver alloys comprising the steps of:
alloying at least 90.0 percent silver, at least 2.0 percent copper and from about 0.28 weight percent to about 4.0 weight percent tin;
solution annealing and quenching said alloy at a temperature ranging from 1250°-1400° F. for a period of time between about ½ hour to about 4.0 hours; and
age-hardening by heating said alloy at a temperature ranging from 300°-700° F. for a period of time between ½ hour to about 24.0 hours.

10. A process of making hardened silver alloys comprising the steps of:
alloying at least 90.0 percent silver, at least 2.0 percent copper, from about 0.02 weight percent to about 0.40 weight percent lithium and from about 0.28 weight percent to about 4.0 weight percent tin;
solution annealing and quenching said alloy at a temperature ranging from 1250°-1400° F. for a period of time between about ½ hour to about 40 hours; and
age-hardening by heating said alloy at a temperature ranging from 300°-700° F. for a period of time between about ½ hour to about 24.0 hours.

11. A process of making hardened silver alloys comprising the steps of:
alloying at least 90.0 percent silver, at least 2.0 percent copper, from about 0.02 weight percent to about 0.40 weight percent lithium and from about 0.10 weight percent to about 0.80 weight percent antimony;
solution annealing and quenching said alloy at a temperature ranging from 1250°-1400° F. for a period of time between about ½ hour to about 4.0 hours; and
age-hardening by heating said alloy at a temperature ranging from 300°-700° F. for a period of time between about ½ hour to about 24.0 hours.

12. A process of making hardened silver alloys comprising the steps of:
alloying at least 90.0 percent silver, at least 2.0 percent copper, from about 0.02 weight percent to about 0.40 weight percent lithium, from about 0.28 weight percent to about 4.0 weight percent tin and from about 0.10 weight percent to about 0.40 weight percent antimony;
solution annealing and quenching said alloy at a temperature ranging from 1250°-1400° F. for a period of time between about ½ hour to about 4.0 hours; and
age-hardening by heating said alloy at a temperature ranging from 300°-700° F. for a period of time between ½ hour to about 24.0 hours.

13. A process of making hardened silver alloys comprising the steps of:
alloying at least 90.0 percent silver, at least 2.0 percent copper, from about 0.02 weight percent to about 0.40 weight percent lithium, from about 0.28 weight percent to about 4.0 weight percent tin and from about 0.10 weight percent to about 0.50 weight percent bismuth;
solution annealing and quenching said alloy at a temperature ranging from 1250°-1400° F. for a period of time between about ½ hour to about 40 hours; and
age-hardening by heating said alloy at a temperature ranging from 300°-700° F. for a period of time between about ½ hour to about 24.0 hours.

* * * * *